US011137178B2

(12) United States Patent
Wu et al.

(10) Patent No.: US 11,137,178 B2
(45) Date of Patent: Oct. 5, 2021

(54) COLD ENERGY RECOVERY-TYPE VARIABLE-CAPACITY AIR-SOURCE HEAT PUMP SYSTEM

(71) Applicant: JIANGSU TENESUN ELECTRICAL APPLIANCE CO., LTD., Nantong (CN)

(72) Inventors: Yunyun Wu, Nantong (CN); Yujun Wang, Nantong (CN); Ying Wang, Nantong (CN); Junhong Li, Nantong (CN); Yi Yang, Nantong (CN); Tianshu Wang, Nantong (CN)

(73) Assignee: JIANGSU TENESUN ELECTRICAL APPLIANCE CO., LTD., Nantong (CN)

( * ) Notice: Subject to any disclaimer, the term of this patent is extended or adjusted under 35 U.S.C. 154(b) by 210 days.

(21) Appl. No.: 16/604,943

(22) PCT Filed: Sep. 18, 2017

(86) PCT No.: PCT/CN2017/102002
§ 371 (c)(1),
(2) Date: Oct. 11, 2019

(87) PCT Pub. No.: WO2018/188269
PCT Pub. Date: Oct. 18, 2018

(65) Prior Publication Data

US 2020/0158386 A1 May 21, 2020

(30) Foreign Application Priority Data

Apr. 14, 2017 (CN) ..... 201710245733.5
Apr. 14, 2017 (CN) ..... 201720393029.X

(51) Int. Cl.
*F25B 30/02* (2006.01)
*F25B 27/00* (2006.01)
(Continued)

(52) U.S. Cl.
CPC ..... *F25B 27/00* (2013.01); *F25B 29/003* (2013.01); *F25B 30/02* (2013.01); *F25B 41/20* (2021.01);
(Continued)

(58) Field of Classification Search
CPC ..... F25B 27/00; F25B 29/003; F25B 30/02; F25B 2313/003; F25B 2339/047;
(Continued)

(56) References Cited

U.S. PATENT DOCUMENTS 4,178,769 A * 12/1979 Johnsen ..... F25B 29/003 62/180
6,298,683 B1 * 10/2001 Kondo ..... F25B 7/00 62/335
(Continued)

*Primary Examiner* — Jonathan Bradford
(74) *Attorney, Agent, or Firm* — CBM Patent Consulting, LLC

(57) ABSTRACT

Disclosed is a cold energy recovery-type variable-capacity air-source heat pump system, relating to combined heating and refrigerating systems running in an alternating or synchronous manner, wherein a first subsystem and a second subsystem share a double-channel variable-capacity heat exchanger; a heat exchanger main body includes two manually independent refrigerant pipe pass channels, and a refrigerant in the two channels synchronously carries out heat exchange with hot medium water in a shell pass channel; the shell pass channel establishes a water-medium heat-supplying circulation via a hot water circulation pipeline and a hot water circulation pump; the first subsystem and the second subsystem are connected to the two refrigerant pipe pass channels via a control valve group.

5 Claims, 4 Drawing Sheets

(51) Int. Cl.

| | |
|---|---|
| ***F25B 29/00*** | (2006.01) |
| ***F25B 49/02*** | (2006.01) |
| ***F25B 41/40*** | (2021.01) |
| ***F25B 41/20*** | (2021.01) |
| *F25B 13/00* | (2006.01) |

(52) U.S. Cl.
CPC ..... *F25B 41/40* (2021.01); *F25B 49/02* (2013.01); *F25B 13/00* (2013.01); *F25B 2313/003* (2013.01); *F25B 2339/047* (2013.01); *F25B 2400/05* (2013.01); *F25B 2400/06* (2013.01); *F25B 2500/02* (2013.01); *F25B 2600/02* (2013.01); *F25B 2600/2519* (2013.01)

(58) Field of Classification Search
CPC ..... F25B 2400/05; F25B 2400/06; F25B 2500/02; F25B 2600/02
See application file for complete search history.

(56) References Cited

U.S. PATENT DOCUMENTS

| | | | | |
|---|---|---|---|---|
| 7,808,783 | B2 * | 10/2010 | Goth | H05K 7/20818 361/700 |
| 2009/0133412 | A1 * | 5/2009 | Narayanamurthy | F24F 5/0017 62/66 |
| 2010/0107683 | A1 * | 5/2010 | MacBain | F28D 7/0066 62/510 |
| 2013/0098086 | A1 * | 4/2013 | Sillato | F25B 49/02 62/184 |

* cited by examiner

| | | |
|---|---|---|
| Constant-capacity mode | First subsystem | 10-11-31-33-17-12-13-11-15-10 |
| | Second subsystem | 20-21-36-32-35-27-22-23-21-25-20 |
| Double-channel variable-capacity mode | | 10-11-31-34-32-37-17-12-13-11-15-10 |

COLD ENERGY RECOVERY-TYPE VARIABLE-CAPACITY AIR-SOURCE HEAT PUMP SYSTEM

BACKGROUND OF THE INVENTION

1. Technical Field

The invention relates to combined heating and refrigerating systems running in an alternating or synchronous manner, in particular to a heat pump-type combined cold and heat supply system which is mainly used to supply heat and can also supply cold energy at the same time.

2. Description of Related Art

The initiation of the slogan of extensive society construction has led to a higher degree of functional integration in building bodies, and how to realize the maximum utilization of energy has become a current issue under discussion. Nowadays, higher and higher requirements are put forward to commerce and business sites: the temperature, humidity, and air cleanliness of the air side should be controlled to be appropriate, and the water temperature of the water side should be moderate all year round. Traditional independent cold or heat supply methods inevitably cause improper resource allocation in different seasons and greatly increase the initial investment cost of equipment. As shown in FIG. 1, which illustrates a chocolate processing process, chocolate products are produced through raw material mixing, melting, fine grinding, refining, screening, heat preservation, temperature regulation, bar molding, and hardening by cooling, and finally are packaged, and in this production process, a large quantity of heat energy and cold energy needs to be supplied, and the temperature is strictly required in all process steps. Traditionally, electrical heating, steam heating, or heat supply by combustion in boilers is usually used for temperature control, and different heat supply methods have to be adopted for processes having different temperature requirements, which increases the operating costs of enterprises, reduces the work efficiency, fails to fulfill intelligent control, and leads to large labor investments. In view of this, it is necessary to improve original energy-consumption production processes so as to develop a combined heating and refrigerating system capable of meeting food processing requirements. Chinese Invention Patent "Control Method and Control Device for Multi-mode Operation of Restaurant Kitchen Heat Pump System" (Invention Patent No. 201410478406.0, Authorized Publication No. CN104197584B) discloses a control method and control device for multi-mode operation of a restaurant kitchen heat pump system, relating to control over combined heating and refrigerating systems, in particular to a control method and device for a comprehensive heat pump system for hot water supply, cooling, dehumidification, cold storage and freshness retaining of a restaurant kitchen, wherein the control device detects measured values of operation mode parameters and compares the measured values with set values to control a multi-mode refrigerant circulation loop switching mechanism to change a refrigerant circulation path, so as to control the restaurant kitchen heat pump system to operate in a preset operation mode, thus, realizing automatic multi-mode operation.

In addition, existing heat pump systems having a heat recovery function generally adopt a heating heat exchanger formed by connection of an independent condenser and an independent heat recoverer, thus, occupying a large space and having a high cost. Chinese Utility Model Patent "Shell-pipe Heat Exchanger and Air Conditioner" (Utility Model Patent No. 201420417296.2, Authorized Publication No. CN204084963U) discloses a shell-pipe heat exchanger and an air conditioner comprising the same, wherein the shell-pipe heat exchanger comprises a condenser and a heat recoverer; one end of the condenser is provided with a cooling water inlet and a cooling water outlet, and the other end of the condenser is sealed; one end of the heat recoverer is provided with a hot water inlet and a hot water outlet, and the other end of the heat recoverer is fixedly connected with the sealed end of the condenser; the sealed end of the condenser and sealed end of the heat recoverer are fixedly connected, and cold medium channels of the heat recoverer and the condenser are connected via a connection pipe, so that the normal condensation function and heat recovery function of the shell-pipe heat exchanger are guaranteed, the shell-pipe heat exchanger is compact in structure, the installation space is saved, and the cost is reduced. However, by adoption of existing technical solutions, although the two independent functional components are mechanically designed into a whole, their functions still remain mutually independent, and thus, the overall heat exchange efficiency of the heat exchanger fails to actually be improved.

BRIEF SUMMARY OF THE INVENTION

The objective of the invention is to provide a cold energy recovery-type variable-capacity air-source heat pump system, so as to reduce equipment sizes, equipment investments and operating costs, and to improve heat exchange efficiency and unit energy efficiency in the process of replacing a traditional heating method with a heat pump-type combined cold and heat supply system.

The technical solution adopted by the invention to fulfill the above objective is as follows:

A cold energy recovery-type variable-capacity air-source heat pump system comprises a first subsystem composed of a first compressor and a cold energy recovery-type heat exchanger, and a second subsystem composed of a second compressor and a finned heat exchanger, wherein:

the first subsystem and the second subsystem share one double-channel variable-capacity heat exchanger as a water-cooled condenser; the double-channel variable-capacity heat exchanger comprises a heat exchanger main body and a control valve group which is composed of electromagnetic valves and one-way valves; the heat exchanger main body comprises two mutually independent refrigerant pipe pass channels which are arranged in one shell pass channel, and a refrigerant in the two refrigerant pipe pass channels synchronously carries out heat exchange with water in the shell pass channel; the shell pass channel of the heat exchanger main body establishes a water-medium heat-supplying circulation by means of a hot water circulation pipeline and a hot water circulation pump;

the first subsystem and the second subsystem are connected to the two refrigerant pipe pass channels via the control valve group so as to establish a dynamically controllable refrigerant circulation loop; and by means of control over a switch state of the control valve group of the double-channel variable-capacity heat exchanger, dynamic multi-mode operation of the heat pump system is realized.

According to a preferred technical solution of the cold energy recovery-type variable-capacity air-source heat pump system, the double-channel variable-capacity heat exchanger comprises a shell-pipe-type heat exchanger serving as the heat exchanger main body and a control valve group connected to refrigerant pipe pass channels of the shell-pipe-type heat exchanger; a first refrigerant channel and a second refrigerant channel which are independent of each other are formed in the heat exchanger main body, and the two refrigerant pipe pass channels are arranged in a common shell pass channel; the control valve group comprises three electromagnetic valves and two one-way valves, which are connected to the refrigerant pipe pass channels; the electromagnetic valves include a first electromagnetic valve connected to an outlet of the first refrigerant channel, a second electromagnetic valve connected between the outlet of the first refrigerant channel and an inlet of the second refrigerant channel, and a third electromagnetic valve connected to an outlet of the second refrigerant channel; the one-way valves include a first one-way valve connected to the inlet of the second refrigerant channel and a second one-way valve connected between the outlet of the second refrigerant channel and an outlet of the first electromagnetic valve in parallel; an exhaust port of the first compressor is connected to an inlet of the first refrigerant channel via a first four-way valve; the outlet of the first electromagnetic valve is connected in parallel to an outlet of the second one-way valve, then is connected to a refrigerant channel of the cold energy recovery-type heat exchanger via a first expansion valve, and then is connected to an air inlet of the first compressor via the first four-way valve; an exhaust port of the second compressor is connected to an inlet of the first one-way valve via a second four-way valve; and an outlet of the third electromagnetic valve is connected to a refrigerant channel of the finned heat exchanger via a second expansion valve and is then connected to an air inlet of the second compressor via the second four-way valve.

According to a preferred technical solution of the double-channel variable-capacity heat exchanger, the heat exchanger main body is of a vertical structure which has a vertically-through shell pass channel, wherein the first refrigerant channel is arranged on an upper portion of the shell pass channel, and the second refrigerant channel is arranged on a lower portion of the shell pass channel; high-temperature sensible heat of the refrigerant is transferred in the first refrigerant channel to water in the upper portion of the shell pass channel, so that a high-temperature sensible heat exchange area is formed; and latent condensation heat of the refrigerant is transferred to water in the lower portion of the shell pass channel, so that a latent condensation heat exchange area is formed.

According to a preferred technical solution of the cold energy recovery-type variable-capacity air-source heat pump system, a first reservoir is arranged on a connection pipeline between the first refrigerant channel and the first expansion valve, and a second reservoir is arranged on a connection pipeline between the second refrigerant channel and the second expansion valve.

According to an improved technical solution of the cold energy recovery-type variable-capacity air-source heat pump system, the dynamic multi-mode operation includes the following four operation modes:

(1) Cold-heat equilibrium mode of the first subsystem: the first compressor is started, the second compressor is stopped, the first electromagnetic valve is opened, and the second electromagnetic valve is closed; a refrigerant circulation path in this mode is as follows:

The first compressor—the first four-way valve—the first refrigerant channel—the first electromagnetic valve—the first reservoir—the first expansion valve—the cold energy recovery-type heat exchanger—the first four-way valve—the first gas-liquid separator—the first compressor;

(2) Air-source hot-water mode of the second subsystem: the first compressor is stopped, the second compressor is started, the second electromagnetic valve is closed, and the third electromagnetic valve is opened; a refrigerant circulation path in this mode is as follows:

The second compressor—the second four-way valve—the first one-way valve—the second refrigerant channel—the third electromagnetic valve—the second reservoir—the second expansion valve—the finned heat exchanger—the second four-way valve—the second gas-liquid separator—the second compressor;

(3) Double-system constant-capacity hot-water mode: the first compressor and the second compressor are synchronously started, the first electromagnetic valve is opened, the second electromagnetic valve is closed, and the third electromagnetic valve is opened; a refrigerant circulation path of the first subsystem is as follows:

The first compressor—the first four-way valve—the first refrigerant channel—the first electromagnetic valve—the first reservoir—the first expansion valve—the cold energy recovery-type heat exchanger—the first four-way valve—the first gas-liquid separator—the first compressor;

A refrigerant circulation path of the second subsystem is as follows:

The second compressor—the second four-way valve—the first one-way valve—the second refrigerant channel—the third electromagnetic valve—the second reservoir—the second expansion valve—the finned heat exchanger—the second four-way valve—the second gas-liquid separator—the second compressor;

(4) Double-channel variable-capacity operation mode: the first compressor is started, the second compressor is stopped, the first electromagnetic valve is closed, the second electromagnetic valve is opened, and the third electromagnetic valve is closed; a refrigerant circulation path in this mode is as follows:

The first compressor—the first four-way valve—the first refrigerant channel—the second electromagnetic valve—the second refrigerant channel—the second one-way valve—the first reservoir—the first expansion valve—the cold energy recovery-type heat exchanger—the first four-way valve—the first gas-liquid separator—the first compressor.

According to a further improved technical solution of the cold energy recovery-type variable-capacity air-source heat pump system, the air-source heat pump system changes a heat exchange area of the finned heat exchanger according to recovered refrigeration cold energy, so that the overall system size of the heat pump system is reduced while the unit heating capacity is guaranteed;

The range of variation of the heat exchange area S of the finned heat exchanger is $0\text{-}W_2/q$;

The range of variation of a heat exchange area S1 of the cold energy recovery-type heat exchanger is $0\text{-}(W_1-W_2)/q_1$;

Wherein, the unit heating capacity (kw) meets: $Q_1=W_1+P_i$, wherein $W_1$ is the refrigerating capacity (kw) of an evaporator side of the system in a heating operation mode, $P_i$ is the input power (kw) of the system in the heating operation mode, and $W_2$ is the recovered refrigeration cold energy (kw); the heat exchange area ($m^2$) of the finned heat exchanger meets: $S=W_2/q$, wherein q is the refrigerating capacity in unit area ($kw/m^2$) of an evaporation side in the heating operation mode; the heat exchange area ($m^2$) of the cold energy recovery-type heat exchanger meets: $S_1=(W_1-W_2)/q_1$, wherein $q_1$ is the refrigerating capacity in unit area ($kw/m^2$) of the cold energy recovery-type heat exchanger.

The invention has the following beneficial effects:

1. The cold energy recovery-type variable-capacity air-source heat pump system realizes a double-channel variable-capacity mode via the double-channel variable-capacity heat exchanger so as to effectively use the heat exchange area of the shell-pipe-type heat exchanger, so that the requirement for stable power output under a heavy-load condition is met, the overall unit operating efficiency is greatly improved, and the highly energy-efficient operation of the heat pump system is realized.

2. The cold energy recovery-type variable-capacity air-source heat pump system recovers part of cold energy by means of the double-channel variable-capacity heat exchanger and the cold energy recovery-type heat exchanger which are able to operate in a variable-capacity mode, so that the degree of supercooling of the refrigerant in the subsystems is greatly improved, and the refrigerating capacity of the system is improved.

3. According to the cold energy recovery-type variable-capacity air-source heat pump system, two refrigeration systems share one water-cooled condenser to realize coupled operation, and the cold energy recovery-type heat exchanger is used to reduce the size of the finned evaporator, so that the purpose of reducing the system size is fulfilled, a combined cold and heat supply system can stably operate at low consumption under different cold or heat loads, and the highly energy-efficient operation is realized.

Reference signs of components in the figures: 1, first subsystem; 10, first compressor; 11, first four-way valve; 12, first expansion valve; 13, cold energy recovery-type heat exchanger; 14, cold water circulation pipeline; 15, first gas-liquid separator; 16, first thermal bulb; 17, first reservoir; 18, first defrosting one-way electromagnetic valve; 2, second subsystem; 20, second compressor; 21, second four-way valve; 22, second expansion valve; 23, finned heat exchanger; 24, fan; 25, second gas-liquid separator; 26, second thermal bulb; 27, second reservoir; 28, second defrosting one-way electromagnetic valve; 3, double-channel variable-capacity heat exchanger; 30, heat exchanger main body; 31, first refrigerant channel; 32, second refrigerant channel; 33, first electromagnetic valve; 34, second electromagnetic valve; 35, third electromagnetic valve; 36, first one-way valve; 37, second one-way valve; 38, hot water circulation pipeline; 39, hot water circulation pump.

DETAILED DESCRIPTION OF THE INVENTION

Figure 1:
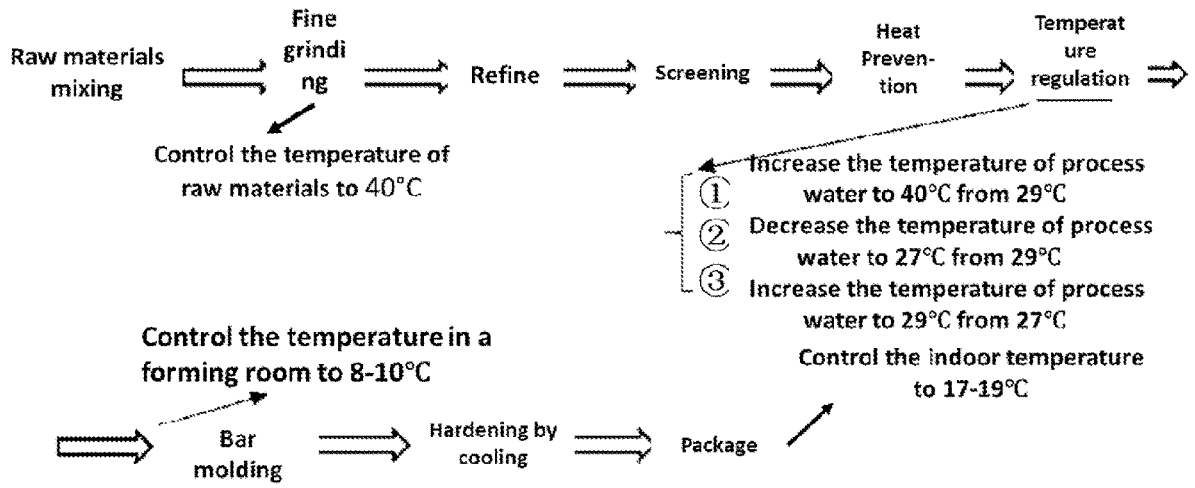
FIG. 1 is a process flow diagram for chocolate processing.
Figure 2:
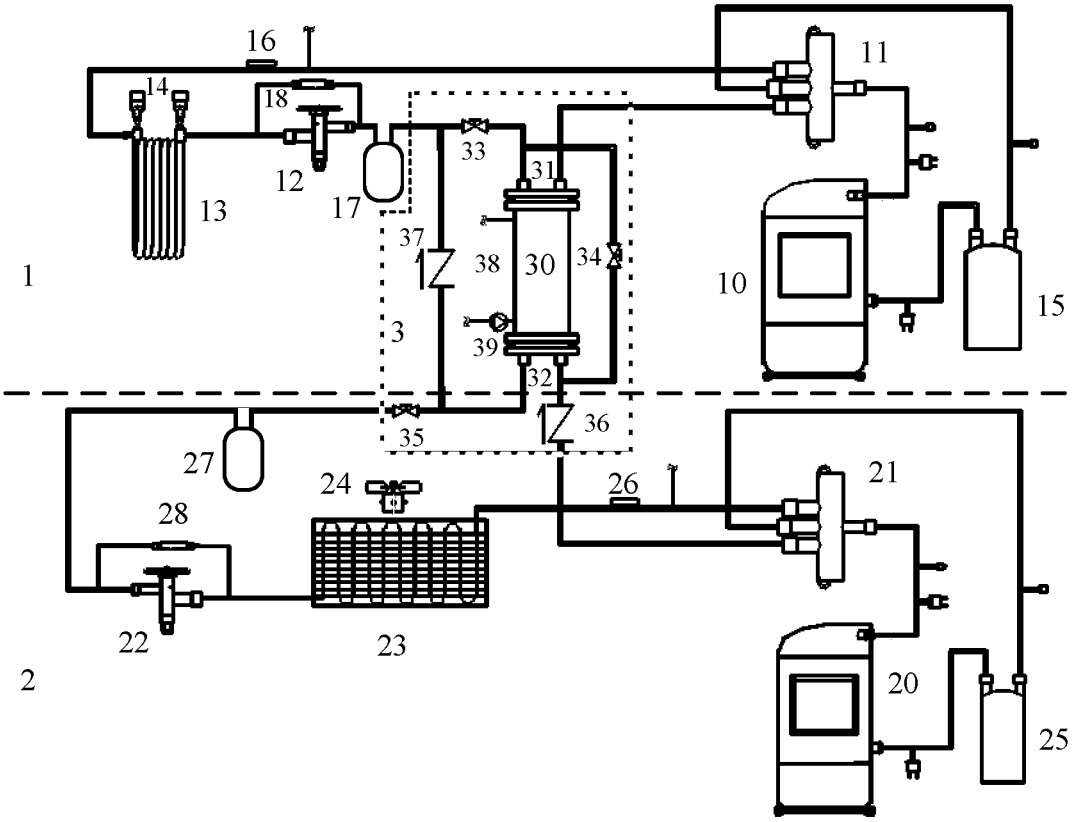
FIG. 2 is a schematic diagram of a cold energy recovery-type variable-capacity air-source heat pump system of the invention.
Figure 3:
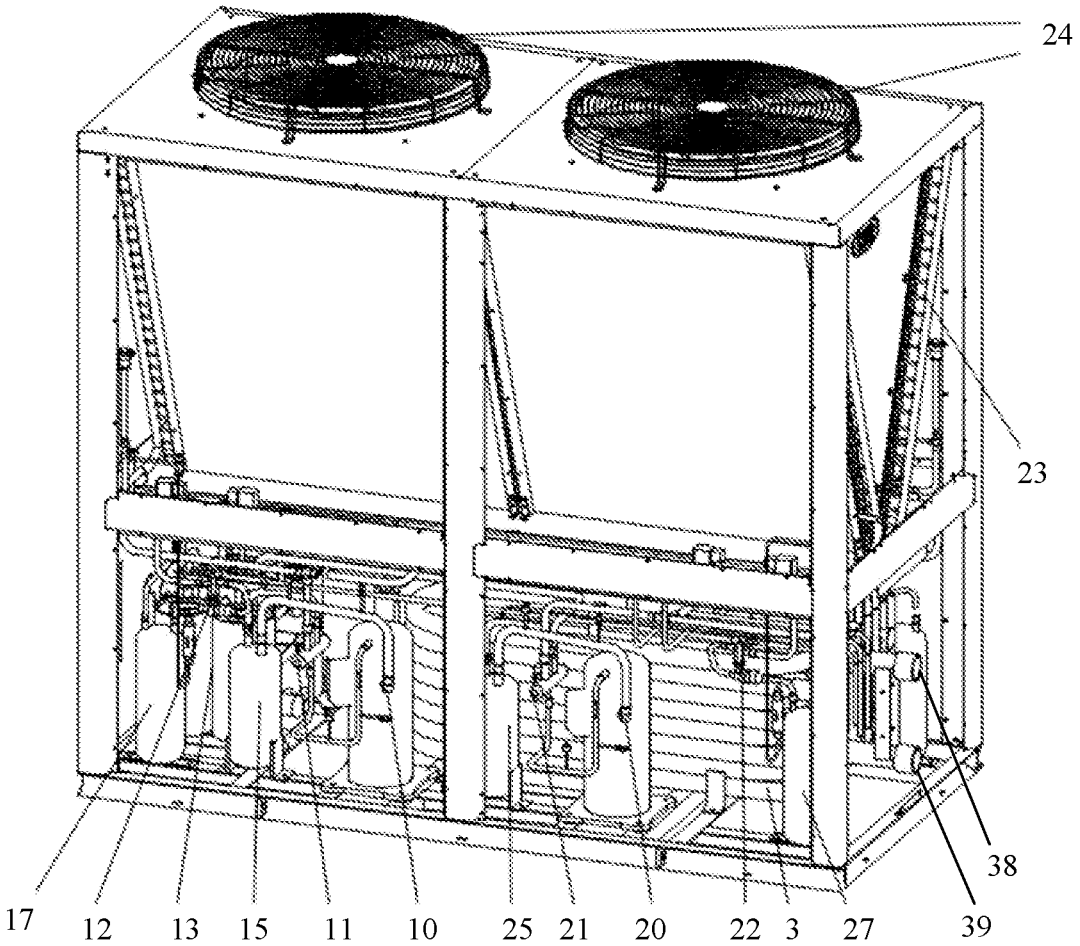
FIG. 3 is an assembled schematic diagram of the cold energy recovery-type variable-capacity air-source heat pump system of the invention.

For the sake of a better understanding of the above technical solutions of the invention, a further detailed description is given below with reference to the accompanying drawings and embodiments. FIG. 2 and FIG. 3 show one embodiment of a cold energy recovery-type variable-capacity air-source heat pump system of the invention. As shown in FIG. 2 and FIG. 3, the cold energy recovery-type variable-capacity air-source heat pump system comprises a first subsystem 1 and a second subsystem 2, wherein the first subsystem 1 is composed of a first compressor 10 and a cold energy recovery-type heat exchanger 13, and the second subsystem 2 is composed of a second compressor 20 and a finned type heat exchanger 23; the first subsystem 1 and the second subsystem 2 share a double-channel variable-capacity heat exchanger 3 as a water-cooled condenser, as shown in FIG. 2; the double-channel variable-capacity heat exchanger 3 comprises a heat exchanger main body 30 and a control valve group, and the control valve group is composed of electromagnetic valves and one-way valves; the heat exchanger main body 30 comprises two mutually independent refrigerant pipe pass channels arranged in one shell pass channel, and a refrigerant in the two refrigerant pipe pass channels synchronously carries out heat exchange with water in the shell pass channel; the shell pass channel of the heat exchanger main body 30 establishes a water-medium heat-supplying circulation by means of a hot water circulation pipeline 38 and a hot water circulation pump 39; the first subsystem 1 and the second subsystem 2 are connected to the two refrigerant pipe pass channels via the control valve group so as to establish a dynamically controllable refrigerant circulation loop; and by means of control over a switch state of the control valve group of the double-channel variable-capacity heat exchanger 3, dynamic multi-mode operation of the heat pump system is realized. For instance, as for a chocolate processing line, a stable heat energy demand of 100 KW and a stable cold energy demand of 50 KW are required in the production process of processing 1T of raw materials into finally packaged products. In this embodiment, the first subsystem 1 uses a tube-in-tube evaporator as the cold energy recovery-type heat exchanger 13 to recover part of cold energy, which is in turn supplied for bar molding, hardening by cooling, packaging and other processes of chocolate processing; and the second subsystem 2 uses the finned heat exchanger 23 to absorb heat energy from an air source, and thus, the overall heating capacity of the heat pump system is improved according to different demands for heat energy and cold energy.

Figures 4, 5:
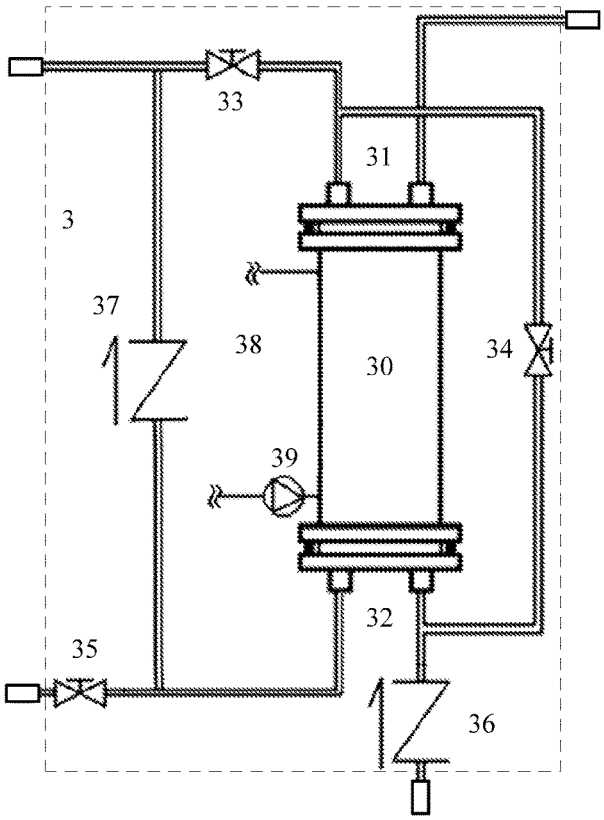
FIG. 4 is a schematic diagram of a double-channel variable-capacity heat exchanger of the invention.
FIG. 5 is schematic diagram of operation modes of the cold energy recovery-type variable-capacity air-source heat pump system of the invention.

In an embodiment shown in FIG. 4, the double-channel variable-capacity heat exchanger 3 comprises a shell-pipe-type heat exchanger serving as the heat exchanger main body 30, and a control valve group connected to refrigerant pipe pass channels of the shell-pipe-type heat exchanger; a first refrigerant channel 31 and a second refrigerant channel 32 which are independent of each other are formed in the heat exchange main body 30, and the two refrigerant pipe pass channels 31 and 32 are arranged in a common shell pass channel; the control valve group comprises three electromagnetic valves and two one-way valves, which are connected to the refrigerant pipe pass channels; the electromagnetic valves include a first electromagnetic valve 33 connected to an outlet of the first refrigerant channel 31, a second electromagnetic valve 34 connected between the outlet of the first refrigerant channel 31 and an inlet of the second refrigerant channel 32, and a third electromagnetic valve 35 connected to an outlet of the second refrigerant channel 32; the one-way valves include a first one-way valve 36 connected to the inlet of the second refrigerant channel 32 and a second one-way valve 37 connected between the outlet of the second refrigerant channel 32 and an outlet of the first electromagnetic valve 33 in parallel; an exhaust port of the first compressor 10 is connected to an inlet of the first refrigerant channel 31 via a first four-way valve 11; the outlet of the first electromagnetic valve 33 is connected in parallel with an outlet of the second one-way valve 37, then is connected to a refrigerant channel of the cold energy recovery-type heat exchanger 13 via a first expansion valve 12, and then is connected to an air inlet of the first compressor 10 via the first four-way valve 11; an exhaust port of the second compressor 20 is connected to an inlet of the first one-way valve 36 via a second four-way valve 21; and an outlet of the third electromagnetic valve 35 is connected to a refrigerant channel of the finned heat exchanger 23 via a second expansion valve 22 and is then connected to an air inlet of the second compressor 20 via the second four-way valve 21.

According to one embodiment of the double-channel variable-capacity heat exchanger of the invention, the heat exchanger main body 30 is of a vertical structure which has a vertically-through shell pass channel, wherein the first refrigerant channel 31 is arranged on an upper portion of the shell pass channel, and the second refrigerant channel 32 is arranged on a lower portion of the shell pass channel; high-temperature sensible heat of the refrigerant is transferred in the first refrigerant channel 31 to water in the upper portion of the shell pass channel, so that a high-temperature sensible heat exchange area is formed; and latent condensation heat of the refrigerant is transferred in the second refrigerant channel 32 to water in the lower portion of the shell pass channel, so that a latent condensation heat exchange area is formed.

According to the embodiment of the cold energy recovery-type variable-capacity air-source heat pump system shown in FIG. 2, a first reservoir 17 is arranged on a connection pipeline between the first refrigerant channel 31 and the first expansion valve 12, and a second reservoir 27 is arranged on a connection pipeline between the second refrigerant channel 32 and the second expansion valve 22.

As shown in FIG. 5, the dynamic multi-mode operation of the cold energy recovery-type variable-capacity air-source heat pump system in this embodiment includes the following four operation modes:

Cold-heat equilibrium mode of the first subsystem: the first compressor 10 is started, the second compressor 20 is stopped, the first electromagnetic valve 33 is opened, and the second electromagnetic valve 34 is closed; a refrigerant circulation path in this mode is as follows:

The first compressor 10—the first four-way valve 11—the first refrigerant channel 31—the first electromagnetic valve 33—the first reservoir 17—the first expansion valve 12—the cold energy recovery-type heat exchanger 13—the first four-way valve 11—the first gas-liquid separator 15—the first compressor 10;

In this mode, the refrigerant in the first refrigerant channel 31 carries out heat exchange with water in the shell pass channel, so that heat energy recovered by the cold energy recovery-type heat exchanger 13 in the cold water production process of the first subsystem 1 is transferred to hot water produced in the shell pass channel of the heat exchanger main body 30;

Air-source hot-water mode of the second subsystem: the first compressor 10 is stopped, the second compressor 20 is started, the second electromagnetic valve 34 is closed, and the third electromagnetic valve 35 is opened; a refrigerant circulation path in this mode is as follows:

The second compressor 20—the second four-way valve 21—the first one-way valve 36—the second refrigerant channel 32—the third electromagnetic valve 35—the second reservoir 27—the second expansion valve 22—the finned heat exchanger 23—the second four-way valve 21—the second gas-liquid separator 25—the second compressor 20;

In this mode, the refrigerant in the second refrigerant channel 32 carries out heat exchange with water in the shell pass channel, so that heat energy absorbed by the finned heat exchanger 23 of the second subsystem 2 from the air source is transferred to hot water produced in the shell pass channel of the heat exchanger main body 30;

Double-system constant-capacity hot-water mode: the first compressor 10 and the second compressor 20 are synchronously started, the first electromagnetic valve 33 is opened, the second electromagnetic valve 34 is closed, and the third electromagnetic valve 35 is opened; a refrigerant circulation path of the first subsystem 1 is as follows:

The first compressor 10—the first four-way valve 11—the first refrigerant channel 31—the first electromagnetic valve 33—the first reservoir 17—the first expansion valve 12—the cold energy recovery-type heat exchanger 13—the first four-way valve 11—the first gas-liquid separator 15—the first compressor 10;

A refrigerant circulation path of the second subsystem 2 is as follows:

The second compressor 20—the second four-way valve 21—the first one-way valve 36—the second refrigerant channel 32—the third electromagnetic valve 35—the second reservoir 27—the second expansion valve 22—the finned heat exchanger 23—the second four-way valve 21—the second gas-liquid separator 25—the second compressor 20;

In the double-system constant-capacity hot-water mode, the refrigerant in the first refrigerant channel 31 carries out heat exchange with water in the shell pass channel, so that heat energy recovered by the cold energy recovery-type heat exchanger 13 in the cold water production process of the first subsystem 1 is transferred to hot water produced in the shell pass channel of the heat exchanger main body 30; and meanwhile, the refrigerant in the second refrigerant channel 32 carries out heat exchange with water in the shell pass channel, so that heat energy absorbed by the finned heat exchanger 23 of the second subsystem 2 from the air source is transferred to hot water produced in the shell pass channel of the heat exchanger main body 30;

(4) Double-channel variable-capacity mode: the first compressor 10 is started, the second compressor 20 is stopped, the first electromagnetic valve 33 is closed, the second electromagnetic valve 34 is opened, and the third electromagnetic valve 35 is closed; a refrigerant circulation path in this mode is as follows:

The first compressor 10—the first four-way valve 11—the first refrigerant channel 31—the second electromagnetic valve 34—the second refrigerant channel 32—the second one-way valve 37—the first reservoir 17—the first expansion valve 12—the cold energy recovery-type heat exchanger 13—the first four-way valve 11—the first gas-liquid separator 15—the first compressor 10;

In the double-channel variable-capacity mode, high-temperature and high-pressure refrigerant gas exhausted via the exhaust port of the first compressor 10 of the cold energy recovery-type variable-capacity air-source heat pump system enters the double-channel variable-capacity heat exchanger 3 via the first four-way valve 11 and flows through the first refrigerant channel 31 to carry out primary heat exchange to form a refrigerant gas-liquid mixture, which then returns into the double-channel variable-capacity heat exchanger 3 via the second electromagnetic valve 34; the refrigerant gas-liquid mixture carries out heat exchange again in the second refrigerant channel 32 with a water side of the heat exchanger main body 30 to be condensed into high-pressure and normal-temperature refrigerant liquid, which flows through the second one-way valve 37 to be converted into low-pressure refrigerant liquid under the throttling effect of the first expansion valve 12; the low-pressure refrigerant liquid enters the tube-in-tube heat exchanger serving as the cold energy recovery-type heat exchanger 13 and absorbs heat to be evaporated into low-pressure refrigerant gas, which enters the first gas-liquid separator 15 via the first four-way valve 11 and finally enters the air inlet of the first compressor 10, so that the refrigeration circulation path in the double-channel variable-capacity operation mode is formed; and in this mode, the refrigerant passes through the first refrigerant channel 31 and the second refrigerant channel 32 to carry out heat exchange twice with water in the shell pass channel, so that heat energy recovered by the cold energy recovery-type heat exchanger 13 in the cold water production process of the first subsystem 1 is transferred to hot water produced in the shell pass channel of the heat exchanger main body 30.

In the double-channel variable-capacity mode, high-temperature and high-pressure refrigerant gas exhausted via the exhaust port of the first compressor 10 of the cold energy recovery-type variable-capacity air-source heat pump system enters the double-channel variable-capacity heat exchanger 3 via the first four-way valve 11 and flows through the first refrigerant channel 31 to carry out primary heat exchange to form a refrigerant gas-liquid mixture, which then returns into the double-channel variable-capacity heat exchanger 3 via the second electromagnetic valve 34; the refrigerant gas-liquid mixture carries out heat exchange again in the second refrigerant channel 32 with the water side of the heat exchanger main body 30 to be condensed into high-pressure and normal-temperature refrigerant liquid, which flows through the second one-way valve 37 to be converted into low-pressure refrigerant liquid under the throttling effect of the first expansion valve 12; and the low-pressure refrigerant liquid enters the tube-in-tube evaporator serving as the cold energy recovery-type heat exchanger 13 and absorbs heat to be evaporated into low-pressure refrigerant gas, which enters the first gas-liquid separator 15 via the first four-way valve 11 and finally enters the air inlet of the first compressor 10, so that the refrigerant circulation path in the double-channel variable-capacity operation mode is formed.

According to the cold energy recovery-type variable-capacity air-source heat pump system, the degree of supercooling of the refrigerant in the first subsystem 1 is greatly improved by means of the double-channel variable-capacity heat exchanger 3 capable of operating in the variable-capacity mode, and accordingly, the refrigerating capacity of the system is improved. When the second subsystem 2 stops, a heat exchange area of the shell-pipe-type heat exchanger can be effectively used in the double-channel variable-capacity mode, so that the requirement for stable power output under a heavy-load condition is met, the overall unit operating efficiency is greatly improved, and the highly energy-efficient operation of the heat pump system is realized.

According to one embodiment of the cold energy recovery-type variable-capacity air-source heat pump system, the air-source heat pump system changes the heat exchange area of the finned heat exchanger according to recovered refrigeration cold energy, so that the overall system size of the heat pump system is reduced while the unit heating capacity is guaranteed:

The range of variation of the heat exchange area S of the finned heat exchanger 23 is $0\text{-}W_2/q$;

The range of variation of a heat exchange area $S_1$ of the cold energy recovery-type heat exchanger 13 is $0\text{-}(W_1-W_2)/q_1$;

Wherein, the unit heating capacity (kw) meets: $Q_1=W_1+P_i$, wherein $W_1$ is the refrigerating capacity (kw) of an evaporator side of the system in a heating operation mode, $P_i$ is the input power (kw) of the system in the heating operation mode, and $W_2$ is the cold energy (kw) recovered for refrigeration; the heat exchange area ($m^2$) of the finned heat exchanger 23 meets: $S=W_2/q$, wherein q is the refrigerating capacity in unit area ($kw/m^2$) of an evaporator side in the heating operation mode; the heat exchange area ($m^2$) of the cold energy recovery-type heat exchanger 13 meets: $S_1=(W_1-W_2)/q_1$, wherein $q_1$ is the refrigerating capacity in unit area ($kw/m^2$) of the cold energy recovery-type heat exchanger 13.

Those ordinarily skilled in this technical field would appreciate that the above embodiments are only used for illustrating the technical solutions of the invention and are not for limiting the invention, and any variations and modifications of the above embodiments made based on the essential spirit of the invention should also fall within the protection scope of the claims of the invention.

What is claimed is:

1. A cold energy recovery-type variable-capacity air-source heat pump system, comprising a first subsystem composed of a first compressor and a cold energy recovery-type heat exchanger, and a second subsystem composed of a second compressor and a finned heat exchanger, wherein:

the first subsystem and the second subsystem share one double-channel variable-capacity heat exchanger as a water-cooled condenser; the double-channel variable-capacity heat exchanger comprises a heat exchanger main body and a control valve group which is composed of electromagnetic valves and one-way valves; the heat exchanger main body comprises two mutually independent refrigerant pipe pass channels which are arranged in one shell pass channel, and a refrigerant in the two refrigerant pipe pass channels synchronously carries out heat exchange with water in the shell pass channel; the shell pass channel of the heat exchanger main body establishes a water-medium heat-supplying circulation by means of a hot water circulation pipeline and a hot water circulation pump;

the first subsystem and the second subsystem are connected to the two refrigerant pipe pass channels via the control valve group so as to establish a dynamically controllable refrigerant circulation loop; and by means of control over a switch state of the control valve group of the double-channel variable-capacity heat exchanger, dynamic multi-mode operation of the heat pump system is realized;

wherein the double-channel variable-capacity heat exchanger comprises a shell-pipe-type heat exchanger serving as the heat exchanger main body and the control valve group connected to refrigerant pipe pass channels of the shell-pipe-type heat exchanger; a first refrigerant channel and a second refrigerant channel which are independent of each other are formed in the heat exchanger main body, and the two refrigerant pipe pass channels are arranged in a common shell pass channel; the control valve group comprises three electromagnetic valves and two one-way valves, which are connected to the refrigerant pipe pass channels; the electromagnetic valves include a first electromagnetic valve connected to an outlet of the first refrigerant channel, a second electromagnetic valve connected between the outlet of the first refrigerant channel and an inlet of the second refrigerant channel, and a third electromagnetic valve connected to an outlet of the second refrigerant channel; the one-way valves include a first one-way valve connected to the inlet of the second refrigerant channel and a second one-way valve connected between the outlet of the second refrigerant channel and an outlet of the first electromagnetic valve in parallel; an exhaust port of the first compressor is connected to an inlet of the first refrigerant channel via a first four-way valve; the outlet of the first electromagnetic valve is connected in parallel to an outlet of the second one-way valve, then is connected to a refrigerant channel of the cold energy recovery-type heat exchanger via a first expansion valve, and is then connected to an air inlet of the first compressor via the first four-way valve; an exhaust port of the second compressor is connected to an inlet of the first one-way valve via a second four-way valve; and an outlet of the third electromagnetic valve is connected to a refrigerant channel of the finned heat exchanger via a second expansion valve and is then connected to an air inlet of the second compressor via the second four-way valve.

2. The cold energy recovery-type variable-capacity air-source heat pump system according to claim 1, wherein a first reservoir is arranged on a connection pipeline between the first refrigerant channel and the first expansion valve, and a second reservoir is arranged on a connection pipeline between the second refrigerant channel and the second expansion valve.

3. The cold energy recovery-type variable-capacity air-source heat pump system according to claim 1, wherein the heat exchanger main body is of a vertical structure which has a vertically-through shell pass channel, wherein the first refrigerant channel is arranged on an upper portion of the shell pass channel, and the second refrigerant channel is arranged on a lower portion of the shell pass channel; high-temperature sensible heat of the refrigerant is transferred in the first refrigerant channel to water in the upper portion of the shell pass channel, so that a high-temperature sensible heat exchange area is formed; and latent condensation heat of the refrigerant is transferred to water in the lower portion of the shell pass channel, so that a latent condensation heat exchange area is formed.

4. The cold energy recovery-type variable-capacity air-source heat pump system according to claim 2, wherein the dynamic multi-mode operation includes the following four operation modes:

(1) Cold-heat equilibrium mode of the first subsystem: the first compressor is started, the second compressor is stopped, the first electromagnetic valve is opened, and the second electromagnetic valve is closed; a refrigerant circulation path in this mode is as follows:

the first compressor—the first four-way valve—the first refrigerant channel—the first electromagnetic valve—the first reservoir—the first expansion valve—the cold energy recovery-type heat exchanger—the first four-way valve—a first gas-liquid separator—the first compressor;

(2) Air-source hot-water mode of the second subsystem: the first compressor is stopped, the second compressor is started, the second electromagnetic valve is closed, and the third electromagnetic valve is opened; a refrigerant circulation path in this mode is as follows:

the second compressor—the second four-way valve—the first one-way valve—the second refrigerant channel—the third electromagnetic valve—the second reservoir—the second expansion valve—the finned heat exchanger—the second four-way valve—a second gas-liquid separator—the second compressor;

(3) Double-system constant-capacity hot-water mode: the first compressor and the second compressor are synchronously started, the first electromagnetic valve is opened, the second electromagnetic valve is closed, and the third electromagnetic valve is opened; a refrigerant circulation path of the first subsystem is as follows:

the first compressor—the first four-way valve—the first refrigerant channel—the first electromagnetic valve—the first reservoir—the first expansion valve—the cold energy recovery-type heat exchanger—the first four-way valve—the first gas-liquid separator—the first compressor;

a refrigerant circulation path of the second subsystem is as follows:

the second compressor—the second four-way valve—the first one-way valve—the second refrigerant channel—the third electromagnetic valve—the second reservoir—the second expansion valve—the finned heat exchanger—the second four-way valve—the second gas-liquid separator—the second compressor;

(4) Double-channel variable-capacity operation mode: the first compressor is started, the second compressor is stopped, the first electromagnetic valve is closed, the second electromagnetic valve is opened, and the third electromagnetic valve is closed; a refrigerant circulation path in this mode is as follows:

the first compressor—the first four-way valve—the first refrigerant channel—the second electromagnetic valve—the second refrigerant channel—the second one-way valve—the first reservoir—the first expansion valve—the cold energy recovery-type heat exchanger—the first four-way valve—the first gas-liquid separator—the first compressor.

5. The cold energy recovery-type variable-capacity air-source heat pump system according to claim 1, wherein the air-source heat pump system changes a heat exchange area of the finned heat exchanger according to recovered refrigeration cold energy, so that an overall system size of the heat pump system is reduced while a unit heating capacity is guaranteed;

a range of variation of the heat exchange area S of the finned heat exchanger is $0\text{-}W_2/q$;

a range of variation of a heat exchange area $S_1$ of the cold energy recovery-type heat exchanger is $0\text{-}(W_1\text{-}W_2)/q_1$;

wherein, the unit heating capacity (kw) meets: $Q_1=W_1+P_i$, wherein $W_1$ is the refrigerating capacity (kw) of an evaporator side of the system in a heating operation mode, Pi is the input power (kw) of the system in the heating operation mode, and $W_2$ is the recovered refrigeration cold energy (kw); the heat exchange area ($m^2$) of the finned heat exchanger meets: $S=W_2/q$, wherein q is the refrigerating capacity in unit area ($kw/m^2$) of an evaporator side in the heating operation mode; the heat exchange area ($m^2$) of the cold energy recovery-type heat exchanger meets: $S_1=(W_1\text{-}W_2)/q_1$, wherein q1 is the refrigerating capacity in unit area ($kw/m^2$) of the cold energy recovery-type heat exchanger.

* * * * *